US011218818B2

(12) United States Patent
Gil

(10) Patent No.: US 11,218,818 B2
(45) Date of Patent: Jan. 4, 2022

(54) DEVICE AND METHOD FOR MAINTAINING A HEARING AID

(71) Applicant: MG DEVELOPPEMENT, Perols (FR)

(72) Inventor: Jose Antonio Gil, Perols (FR)

(73) Assignee: MG DEVELOPPEMENT, Perols (FR)

( * ) Notice: Subject to any disclaimer, the term of this patent is extended or adjusted under 35 U.S.C. 154(b) by 0 days.

(21) Appl. No.: 17/071,200

(22) Filed: Oct. 15, 2020

(65) Prior Publication Data

US 2021/0112349 A1 Apr. 15, 2021

(30) Foreign Application Priority Data

Oct. 15, 2019 (FR) ..... 19 11483
Dec. 27, 2019 (FR) ..... 19 15652

(51) Int. Cl.
*H04R 25/00* (2006.01)

(52) U.S. Cl.
CPC ..... *H04R 25/602* (2013.01); *H04R 25/65* (2013.01); *H04R 2225/31* (2013.01); *H04R 2225/33* (2013.01)

(58) Field of Classification Search
CPC .. H04R 25/00; H04R 25/602; H04R 2225/31; H04R 2225/33
USPC ..... 381/314, 323
See application file for complete search history.

(56) References Cited

U.S. PATENT DOCUMENTS 6,310,960 B1 * 10/2001 Saaski ..... H01M 10/30 381/323
6,658,124 B1 * 12/2003 Meadows ..... H04R 25/55 381/323
8,948,426 B2 * 2/2015 Thomasson ..... H04R 25/70 381/314
2009/0296968 A1 * 12/2009 Wu ..... H04R 25/00 381/323
2013/0016861 A1 * 1/2013 Kaempf ..... H02J 50/80 381/315
2016/0100261 A1 * 4/2016 Shennib ..... H04R 25/602 381/323
2020/0267483 A1 * 8/2020 Schumaier ..... F26B 3/04

FOREIGN PATENT DOCUMENTS

CN 205 536 939 U 8/2016
FR 3047416 A1 8/2017
FR 3079289 A1 9/2019

* cited by examiner

*Primary Examiner* — Suhan Ni
(74) *Attorney, Agent, or Firm* — Craft Chu PLLC; Andrew W. Chu

(57) ABSTRACT

The maintenance device for at least one hearing aid having an earbud that is connected by an electronic cable to an earloop containing a rechargeable battery includes a device for charging the battery of the hearing aid and an aeraulic circuit that is configured to optimize the drying of the hearing aid.

13 Claims, 2 Drawing Sheets

DEVICE AND METHOD FOR MAINTAINING A HEARING AID

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention falls within the field of hearing-aid maintenance, and more particularly the drying and disinfecting of a hearing aid and the recharging of its rechargeable batteries.

The maintenance device according to the invention is configured for a hearing aid comprising an earloop and a remote earbud. The earbud is an in-ear tip that comprises electronic elements that make it possible to transmit or amplify sounds perceived by at least one microphone that is mounted on the earloop or directly on the earbud. To this end, the earmold comprises a distal part that is designed to be in contact with the auditory canal and a proximal part that connects the earmold to an earloop via an electronic cable. The earloop, which is designed to be placed behind the user's ear, comprises power supply means, a switch, etc.

2. Description of Related Art Including Information Disclosed Under 37 CFR 1.97 and 37 CFR 1.98

Worn daily, a hearing aid is regularly exposed to moisture. This moisture can be due to perspiration, earwax, or ambient humidity. However, an accumulation of moisture can lead to premature oxidation of the electronic components of the hearing aid and to premature degradation thereof.

In order to ensure the correct functioning of the hearing aid and to prolong its life, it is necessary to maintain it regularly. Daily maintenance of a hearing aid may consist in dehumidifying and disinfecting the hearing aid.

To this end, several technical solutions exist for drying and disinfecting a hearing aid.

In general, a device for drying a hearing aid comprises a housing that is equipped with a cover that can be moved between an open position and a closed position. The housing comprises, on the one hand, a drying chamber in which the hearing aid is positioned, and drying means suitable for drying the hearing aid on the other hand. The drying means can be formed by one or more air inlets that are arranged on a first side of the housing, and one or more outlets that are arranged on a second side of the housing.

Devices for drying hearing aids also exist which include a fan in order to accelerate the airflow generated between an air inlet and an air outlet.

In addition, some drying devices include a UV-C lamp so as to disinfect the hearing aid by electromagnetic radiation.

At the same time, the development of rechargeable battery or accumulator technologies is pushing hearing aid manufacturers to integrate rechargeable batteries into new hearing aids that are put on the market.

Therefore, in order to enable the user to recharge the batteries of his hearing aids, chargers that are designed specifically for hearing aids are also appearing on the market.

There are basically two types of hearing aid chargers: one type of charger with electrical contact, and one type of charger without electrical contact that operate primarily through magnetic resonance.

Moreover, the document EP 2 148 159 succinctly describes a device for maintaining a hearing aid which combines a device for recharging a hearing aid and a device for drying a hearing aid within a single housing. This maintenance device includes a disinfection system that uses an electro-aerodynamic pump in order to ionize the air entering the housing. Moreover, this maintenance device comprises a filter at the air intake of the housing that aims to filter the air while in fact reducing the quantities of air volume entering the housing. In the same way, the air exhaust of the housing is equipped with a flow reducer that aims to reduce the air leaving the housing. The reduction in intake and exhaust airflow does not enable moisture to be effectively removed from the interior of the housing.

The result of this problem is poor drying of the earbud and of the earloop of the hearing aid. This poor drying can eventually lead to the oxidation of the electronic components of the earbud, the earloop, or even the battery, such as contactors in the case of battery recharging by electrical contact.

BRIEF SUMMARY OF THE INVENTION

In this context, the applicant has endeavored to develop a compact and portable technical solution that makes it possible to optimize the maintenance cycle of the hearing aid both in terms of drying and of recharging the battery.

To this end, the present invention relates to a maintenance device for at least one hearing aid comprising an earbud that is connected by an electronic cable to an earloop containing a rechargeable battery, the maintenance device comprising a base over which a cover that is hinged to this base is mounted which comprises:

- at least one cradle for recharging the battery of an earloop, the cradle comprising means for charging a battery with or without contacting of the earloop and being arranged in the vicinity of a plate that delimits the upper face of the base of the maintenance device,
- at least one receiving compartment which is configured to receive at least one earbud,
- an air intake in a side wall or a bottom wall of the base,
- airflow acceleration means arranged in a chamber that communicates with the outside of the housing via the air intake, the chamber being arranged in the interior of the base below the receiving compartment and the charging cradle, at least one opening that communicates between the chamber and the receiving compartment so as to transfer the airflow to the receiving compartment in order to dry at least one hearing aid earbud, and a rechargeable battery supplying power to at least the recharging means and the airflow acceleration means.

The cover further comprises an air outlet for discharging the air having circulated in the maintenance device.

According to the invention, the maintenance device is characterized in that the receiving compartment extends below the plate, the receiving compartment comprising, on the one hand, an open mouth in the vicinity of the plate ensuring the passage of an electronic cable of a hearing aid and, on the other hand, a lower compartment in which the at least one opening is formed, the lower compartment being configured to receive a hearing aid earbud, the lower compartment having dimensions that are greater than those of the mouth and extending at least partially under the charging cradle so as to create a swirling airflow in the lower compartment.

Advantageously, the position and the configuration of the receiving compartment make it possible, firstly, to generate a swirling airflow within the receiving compartment, and secondly, for the airflow to pass through the mouth in order to become turbulent between the plate and the cover before escaping through the exhaust port. The configuration of the receiving compartment cooperates with the flow acceleration means to optimize the circulation of air inside the housing. The result of this cooperation is optimal drying of the earbuds and earloops.

The invention also relates to a method for maintaining at least one hearing aid which is characterized in that it comprises the following steps:

providing a maintenance device as defined according to the invention, detecting the presence of at least one earloop of a hearing aid in a charging cradle, starting the maintenance cycle, starting the charging of the battery of each hearing aid, generating an ascending airflow that swirls in the lower compartment and/or at the charging cradle, maintaining a temperature of between 25° C. and 35° C. within the receiving compartment and each charging cradle, checking the battery charge level of at least one hearing aid, detecting the maximum battery charge level of at least one hearing aid, and stopping the charging of the hearing aid battery and stopping the generation of airflow in the maintenance device.

The maintenance method makes it possible to optimize the charging of the battery of a hearing aid by optimizing the management of the drying function, particularly by managing the temperature in the maintenance chamber.

BRIEF DESCRIPTION OF THE SEVERAL VIEWS OF THE DRAWINGS

Other features and advantages will appear in the following detailed description of a non-limiting exemplary embodiment of the invention, which is illustrated by the enclosed FIGS. 1 to 2.

DETAILED DESCRIPTION OF THE INVENTION

The invention relates to a maintenance device 100 for at least one hearing aid 3 comprising an earbud that is connected by an electronic cable to an earloop containing a rechargeable battery. In practice, the maintenance device 100 is more particularly configured to ensure the daily maintenance of a pair of hearing aids 3.

Figure 1:
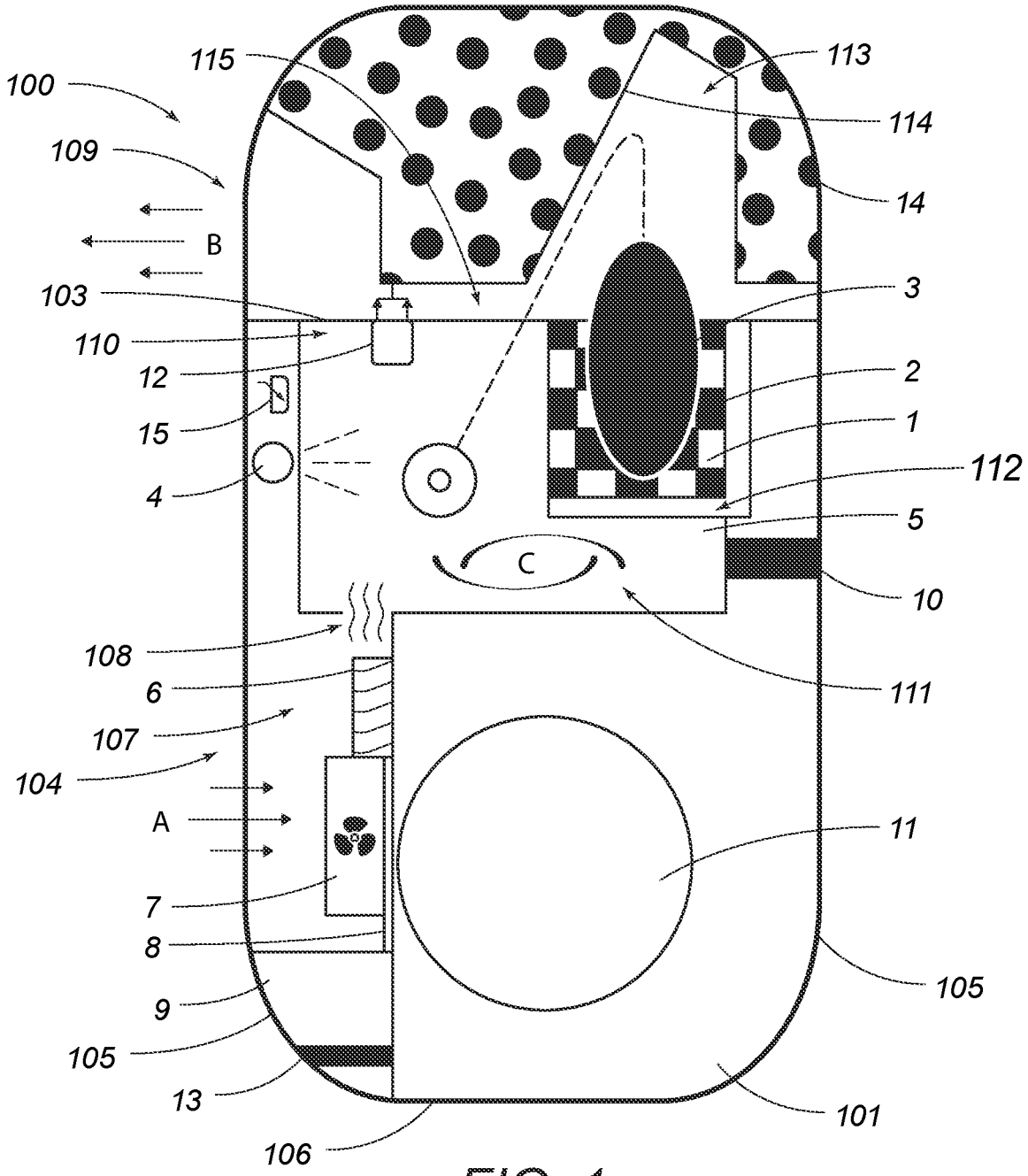
FIG. 1 is a perspective view of a representation of a maintenance device according to an exemplary embodiment of the invention, the cover of the device being open.
Figure 2:
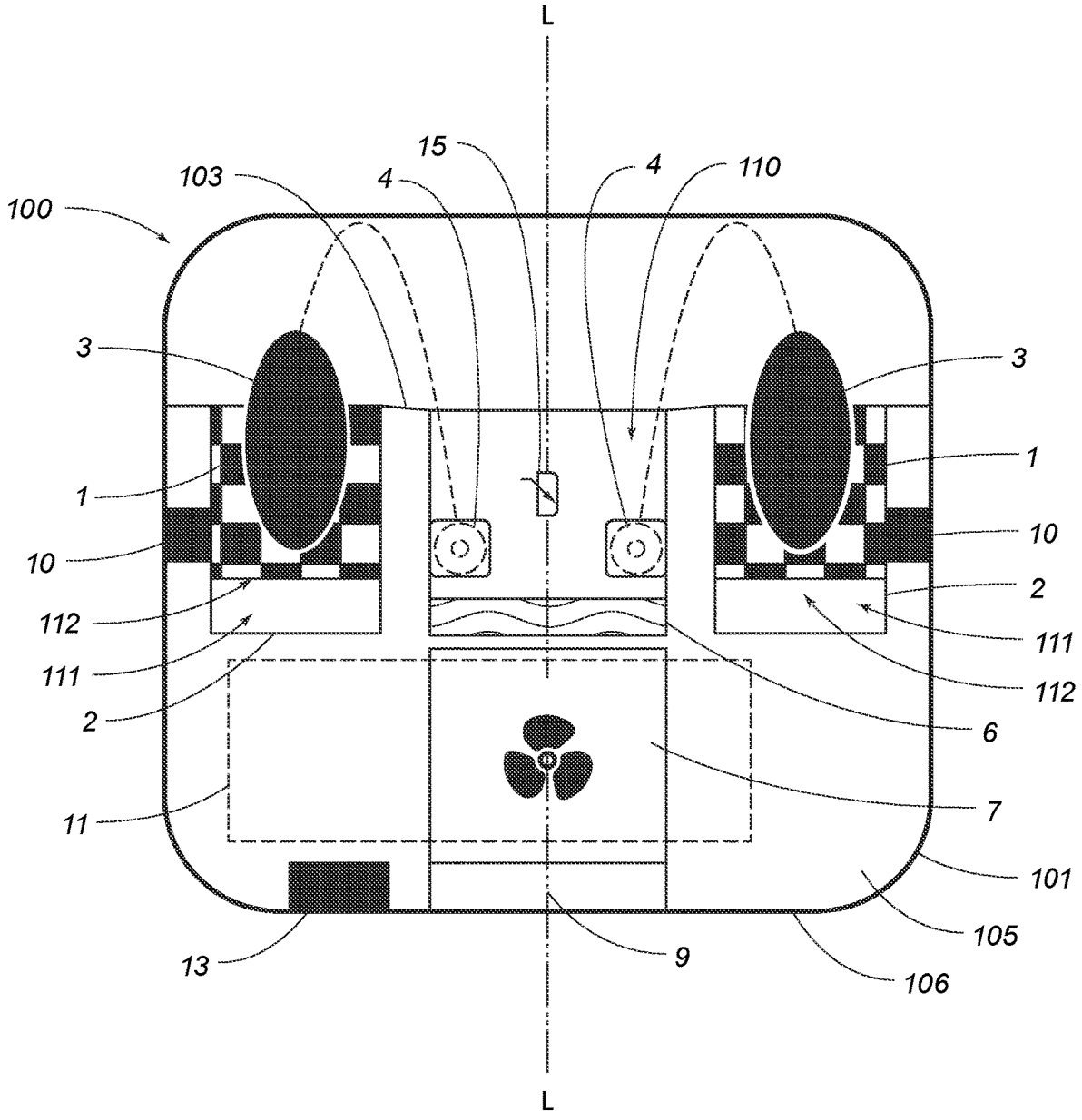
FIG. 2 is a schematic view of a representation of a cross section of the maintenance device of FIG. 1.

As is illustrated in FIGS. 1 and 2, the maintenance device 100 comprises a base 101 over which a cover 14 is mounted. The cover 14 is articulated to this base 101 by means of a hinge (not shown). The base 101 and the cover 14 form a housing.

The base 101 comprises at least one charging cradle 1 for an earloop. In the example illustrated in FIG. 2, the base 101 preferably comprises two charging cradles 1. The two charging cradles 1 are respectively arranged on either side of a longitudinal center axis L-L of the housing. The charging cradle 1 comprises means 2 for charging a battery with or without contacting of the earloop. Here, the cradle 1 is arranged at the level of a plate 103 that delimits the upper face of the base 101 of the housing.

The base 101 comprises at least one receiving compartment 5 which is configured to receive at least one earbud. Preferably, the base 101 comprises a receiving compartment 5 which is configured to receive two earbuds. Each earbud belongs to a separate hearing aid 3.

The base 101 comprises an air intake 104 which is formed in a side wall 105 or lower wall 106 of the base 101. The air intake 104 marks the start of the aeraulic circuit of the maintenance device 100. As is illustrated in FIG. 1, the air intake 105 ensures the entry of an airflow A entering the base 101 of the maintenance device 100. In this example, the air intake 104 is disposed in a side wall 105 of the base 101. The air intake 104 can consist of holes made in a wall 105, 106 of the housing. The holes can be of several shapes—i.e., circular, oblong, rectilinear, rectangular, etc. The air intake 104 can also consist of a single orifice with or without the protection of a screen.

Advantageously, the base 101 comprises means for accelerating the airflow. The means for accelerating the airflow are arranged in a chamber 107 that communicates with the outside of the housing via the air intake 104. The airflow acceleration means optimize the drying of the earbud of the hearing aid 3. The chamber 107 is arranged in the interior of the base 101 below the receiving compartment 5 and the charging cradle 1.

The base 101 comprises at least one opening 108 that communicates between the chamber 107 and the receiving compartment 5. This feature contributes to the transfer of the airflow to the receiving compartment 5 for the purpose of drying at least one hearing aid earbud 3. Preferably, the base 101 comprises two openings 108 that are arranged symmetrically relative to a longitudinal center axis L-L of the housing.

The base 101 comprises a rechargeable battery 11 that supplies power to at least the charging means 2 and the airflow acceleration means. The rechargeable nature of the battery 11 gives the maintenance device its nomadic character. Preferably, the battery 11 has a capacity that enables 2 to 3 maintenance cycles to be carried out. For instance, it is possible to opt for a lithium-ion type battery with a capacity of 2000 mA/h, which allows for 3 maintenance cycles. It should be noted that it is possible to perform 5 maintenance cycles by opting for a 3500 mA/h battery.

The cover 14 comprises an air exhaust 109 in order to evacuate the air that has circulated in the housing. The air exhaust 109 constitutes the end of the aeraulic circuit of the housing. The air exhaust 109 ensures the evacuation of an outgoing airflow B. The air exhaust 109 is provided on the rear face of the cover 14. It should be noted that, like the air intake 104, it can consist of holes made in the wall of the cover 14.

As is illustrated in FIGS. 1 and 2, the receiving compartment 5 extends below the plate 103. In addition, this receiving compartment 5 comprises an open mouth 110 in the vicinity of the plate 103. The open mouth 110 ensures the passage of an electronic cable of a hearing aid 3. The receiving compartment 5 also comprises a lower compartment 111 where said opening 108 is formed. The lower compartment 111 is configured to receive a hearing aid earbud 3. In addition, the lower compartment 111 has dimensions that are greater than those of the mouth 110 and extends at least partially under the charging cradle 1. This creates a swirling airflow C in the lower compartment 111.

Said opening 108 is formed in the bottom of the lower compartment 111. This opening 108 is offset relative to the mouth 110 of the receiving compartment 5. Moreover, this opening 108 allows an ascending airflow to be transferred to the lower compartment 111. Advantageously, the ascending airflow enters into a turbulent state C in the lower compartment 111. The swirling is due, in particular, to the offset nature of the opening 108 relative to the mouth 110.

According to the invention, the charging cradle 1 comprises an orifice 112 that communicates with the lower compartment 111, whereby an ascending airflow passes directly from the lower compartment 111 to the charging cradle 1. The orifice 112 helps to dry the earloop that is disposed in the charging cradle. When the earloop is holding a rechargeable contact battery, the upward flow of air entering the charging cradle allows the contactors to dry and thus optimize charging. Drying the contactors also makes it possible to extend the battery life of the hearing aid 3 by preventing premature oxidation of the contactors.

As is illustrated in FIG. 1, the cover 14 comprises at least one cavity 113. When the cover 14 is closed, this cavity 113 is disposed axially to at least one cradle 1 so as to form an air circulation chamber. This air circulation chamber is located in the vicinity of an earloop and makes it possible to optimize drying thereof.

In particular, the cavity 113 is delimited frontally by a chamfered wall 114; when the cover is closed, the chamfered wall 114 does not mate with the charging cradle 1. The housing thus comprises a slot 115 that enables air to circulate between the cavity 113 and the receiving compartment 5. Advantageously, the wall chamfer 114 also participates in the positioning of the earbud by guiding the positioning of the electronic cable of the hearing aid 3.

In this example, the means for accelerating the airflow comprises a resistor 6 which naturally accelerates the upward airflow by expansion of the heated air. As is illustrated in FIG. 1, the resistor 6 is positioned in the chamber 107. More precisely, the resistor 6 is arranged in the chamber 107 along the axis of the opening 108. Thus, the incoming airflow A is forced to come into contact with the resistor 6 before passing into the receiving compartment 5.

According to another possibility of the invention, the acceleration means comprises a turbine 7 which is arranged in the chamber 107 on the axis of the air intake 104. The turbine 7 accelerates the entry of the airflow into the housing. The latter is thus placed under overpressure in order to optimize the drying of the hearing aid 3.

It should be noted that the turbine 7 can be associated with a resistor 6 or be used alone. Likewise, the resistor 6 can be used alone or in combination with the turbine 7. However, the combination of the turbine 7 and the resistor 6 makes it possible to optimize the maintenance cycle and, in particular, the drying of the hearing aid 3 in a given period of time.

According to one variant of the invention, the maintenance device 100 comprises UV-C and/or UV-A irradiation means 4. The irradiation means 4 is arranged in the lower compartment 111 and supplied with power by the rechargeable battery 11 of the housing. Preferably, the irradiation means comprises a UV LED having an irradiation angle of between 80° and 160°. Preferably, the irradiation angle of the UV LED is between 100° and 140°, the irradiation angle of the UV LED being preferably 120°.

Preferably, the maintenance device 100 comprises two UV LEDs that are arranged symmetrically relative to a longitudinal center axis L-L of the housing.

The maintenance device 100 comprises a breaker 12 that is arranged at one end of the base 101. According to this configuration, the breaker 12 is configured to cooperate with the cover 14. When the cover 14 is closed, the breaker 12 is activated and the maintenance device 100 can start its maintenance cycle. Conversely, as soon as the cover 14 is opened, the breaker 12 is deactivated, and the maintenance device 100 immediately ceases its maintenance cycle. Advantageously, the breaker 12 acts as a safeguard with respect to stopping the diffusion of UV light. This is because UV light can be harmful to the user's eyes.

The maintenance device 100 has a temperature sensor 15 that is arranged at the mouth 110. The temperature sensor 15 makes it possible to measure the temperature in the enclosure of the housing during a maintenance cycle.

In addition, the maintenance device 100 comprises electronic means 8 for managing a maintenance cycle. The electronic means 8 actuates at least the recharging means 2 and the airflow acceleration means. The electronic means 8 comprises a processor and a memory which make it possible to store and execute algorithms for managing the maintenance cycle. For this purpose, the electronic means 8 are connected and control: the recharging means 2, the airflow acceleration means, the irradiation means 4.

The electronic means 8 is also connected to the temperature sensor 15. Therefore, the electronic means manages the flow acceleration means in order to maintain a temperature of between 25° and 35° in the maintenance chamber. This temperature range is optimal for charging the battery of the hearing aid 3 and also helps prevent degradation of the electronic components of the hearing aid 3.

It should be noted that the rechargeable battery 11 of the maintenance device 100 also supplies power to the electronic means 8, the temperature sensor 15, and a light indicator 13 that is arranged opposite the base 101. The light indicator 13 gives an indication of the charge state of the batteries of the hearing aids 3. The light indicator 13 can also inform the user as to the charge state of the battery 11 of the maintenance device 100.

Furthermore, the invention also relates to a method for maintaining at least one hearing aid 3.

The method comprises a step of providing a maintenance device 100 according to the invention.

The electronic means 8 then manages the maintenance cycle through a succession of steps described below.

The method thus comprises a step of detecting the presence of at least one hearing aid 3 in a charging cradle 1.

In the affirmative, the method then comprises a step of starting the maintenance cycle. It should be noted that the step of starting the cycle is effective only when the breaker 12 is activated. In this sense, the method can comprise a step of activating the breaker 12. As mentioned above, the breaker 12 is activated when the cover 14 is closed.

When the conditions are met, the method comprises a step of starting the charging of the battery of each hearing aid 3. This step consists in delivering, through the recharging means 2, an electric current from the battery 11 of the maintenance device 100 to the battery of the hearing aid 3.

In parallel, the method generates an ascending airflow that becomes turbulent in the lower compartment 111 and/or at the charging cradle 1. This corresponds to the activation of the drying function of the maintenance device 100.

In addition, in order to optimize the recharging of the battery of the hearing aid 3, the method comprises a step of maintaining the temperature between 25° C. and 35° C. within the maintenance chamber. In particular, the temperature is maintained between 25° C. and 35° C. within the receiving compartment 5 and each charging cradle 1.

The method can also comprise a step of checking the charge level of the battery of at least one hearing aid 3. This step can be performed at a determined frequency in order to regularly check the battery charge level of the hearing aid 3.

The method comprises a step of detecting the maximum charge level of the battery of at least one hearing aid 3. Preferably, the method detects the maximum charge level of the batteries of two hearing aids 3 that are respectively arranged in each charging cradle 1.

When the maximum charge level of at least one battery of a hearing aid is detected, the method stops charging the battery and generating an airflow. The maintenance cycle is thus stopped.

The maintenance cycle is preferably stopped when the charge level of the batteries of each hearing aid 3 is detected.

I claim:

1. A maintenance device for at least one hearing aid having an earbud that is connected by an electronic cable to an earloop containing a rechargeable battery, the maintenance device comprising:

a base over which a cover that is hinged to this base is mounted, at least one charging cradle for the battery of an earloop, the cradle comprising charging means of a battery with or without contacting of the battery of an earloop, the cradle being arranged at the level of a plate that delimits the upper face of the base of the maintenance device, at least one receiving compartment which is configured to receive at least one earbud, an air intake which is formed in a side wall or a bottom wall of the base, airflow acceleration means disposed in a chamber that communicates with the exterior of the maintenance device via the air intake, the chamber being arranged in the interior of the base below the receiving compartment and the charging cradle, at least one opening that communicates between the chamber and the receiving compartment so as to transfer the airflow to the receiving compartment in order to dry at least one hearing aid earbud, and a rechargeable battery that supplies power at least to the charging means and the airflow acceleration means, wherein the cover comprises an air outlet for discharging the air which has circulated in the maintenance device, wherein the receiving compartment extends below the plate, wherein the receiving compartment comprises an open mouth in the vicinity of the plate ensuring the passage of an electronic cable of a hearing aid, and wherein a lower compartment at which the at least one opening is formed, the lower compartment being configured to receive a hearing aid earbud, the lower compartment having dimensions that are greater than those of the mouth and extending at least partially under the charging cradle so as to create a swirling airflow in the lower compartment.

2. The maintenance device according to claim 1, wherein the at least one opening is offset relative to the mouth of the receiving compartment.

3. The maintenance device according to claim 1, wherein the charging cradle comprises an orifice that communicates with the lower compartment, whereby an ascending airflow passes directly from the lower compartment to the charging cradle.

4. The maintenance device according to claim 1, wherein the cover comprises at least one cavity, this cavity being arranged axially to at least one charging cradle when the cover is closed so as to form an air circulation chamber.

5. The maintenance device according to claim 4, wherein the cavity is delimited frontally by a chamfered wall, the chamfered wall not mating with the charging cradle when the cover is closed and having a slot that enables air to circulate between the cavity and the receiving compartment, the chamfered wall participating in the positioning of the earbud and guiding the positioning of the electronic cable.

6. The maintenance device according to claim 1, wherein the means for accelerating the airflow comprises a resistor which naturally accelerates the upward airflow through expansion of the heated air, the resistor being arranged lower and axially relative to the opening.

7. The maintenance device according to claim 1, wherein the acceleration means comprises a turbine which is arranged on the axis of the air inlet, the turbine accelerating the entry of the airflow into the maintenance device, which is then under overpressure.

8. The maintenance device according to claim 1, further comprising: UV-C and/or UV-A irradiation means, the irradiation means being arranged in the lower compartment and supplied with power by the rechargeable battery of the maintenance device.

9. The maintenance device according to claim 8, wherein the irradiation means comprises a UV LED having an irradiation angle of between 80° and 160°.

10. The maintenance device according to claim 1, further comprising: a breaker that is arranged at a junction between the base and the cover, the breaker being configured to stop the operation of the maintenance device when the cover is opened.

11. The maintenance device according to claim 1, further comprising: a temperature sensor which is arranged at the mouth.

12. The maintenance device according to claim 1, further comprising: electronic means for managing a maintenance cycle that actuates at least the charging means and the airflow acceleration means.

13. A method for maintaining at least one hearing aid, the method comprising the steps of:

providing a maintenance device as defined according to claim 1, detecting the presence of at least one earloop of a hearing aid in a charging cradle, starting the maintenance cycle, starting the charging of the battery of each hearing aid, generating an ascending airflow that becomes turbulent in the lower compartment and/or at the charging cradle, maintaining a temperature of between 25° C. and 35° C. within the receiving compartment and each charging cradle, checking the battery charge level of at least one hearing aid, detecting the maximum battery charge level of at least one hearing aid, and stopping the charging of the battery of the hearing aid and the generation of an airflow in the maintenance device.

* * * * *